United States Patent [19]

Philip, Jr. et al.

[11] Patent Number: 4,794,070

[45] Date of Patent: Dec. 27, 1988

[54] AUTOMATICALLY PROCESSIBLE PHOTOGRAPHIC ELEMENT COMPRISING A NON-SILVER HALIDE LAYER CONTAINING BROMIDE

[75] Inventors: James B. Philip, Jr.; Peter D. Sills; James E. Lindquist, all of St. Paul, Minn.

[73] Assignee: Minnesota Mining and Manufacturing Company, St. Paul, Minn.

[21] Appl. No.: 59,931

[22] Filed: Jun. 9, 1987

[51] Int. Cl.[4] ..... G03C 1/46; G03C 1/06

[52] U.S. Cl. ..... 430/502; 430/508; 430/608; 430/944; 430/963; 430/966

[58] Field of Search ..... 430/502, 508, 608, 489, 430/944, 963, 966

[56] References Cited

U.S. PATENT DOCUMENTS

| | | | |
|---|---|---|---|
| 3,501,299 | 3/1970 | Pestalozzi et al. | 430/608 |
| 3,900,323 | 8/1975 | MacLeish et al. | 430/608 |
| 4,302,525 | 11/1981 | Baker, III et al. | 430/570 |
| 4,332,888 | 6/1982 | Corben | 430/570 |
| 4,431,729 | 2/1984 | Falxa | 430/567 |
| 4,496,652 | 1/1985 | Haugh et al. | 430/569 |
| 4,536,473 | 8/1985 | Mihara | 430/575 |

FOREIGN PATENT DOCUMENTS

| | | | |
|---|---|---|---|
| 174018 | 2/1981 | European Pat. Off. . | |
| 0071344 | 2/1983 | European Pat. Off. | 430/489 |

*Primary Examiner*—Paul R. Michl
*Assistant Examiner*—Patrick A. Doody
*Attorney, Agent, or Firm*—Donald M. Sell; Mark A. Litman

[57] ABSTRACT

Automatic processing equipment for photographic film, particularly radiographic black-and-white film, are required to handle different brands and constructions of film with the same processing chemistry. The Applicants have found that developer chemistry fluctuations seem to be very high when processing conventional films and newer, lower silver coating weight films. It has been found that the addition of an aqueous soluble, non-photosensitive bromide salt into radiographic film reduces the developer chemistry fluctuations.

16 Claims, 1 Drawing Sheet

AUTOMATICALLY PROCESSIBLE PHOTOGRAPHIC ELEMENT COMPRISING A NON-SILVER HALIDE LAYER CONTAINING BROMIDE

BACKGROUND OF THE INVENTION

1. Field of the Invention

The present invention relates to photographic film which can be developed in automatic processors, and particularly to black-and-white radiographic film which will reduce developer chemistry fluctuations in automatic processors.

2. Background of the Invention

Silver halide grains and emulsions are made by a complex sequence of steps in which the grains are grown, chemically modified, sensitized and variously treated to create grains and emulsions of particular shapes, sizes and properties. During these steps, many different chemicals are combined and reacted. One particular subclass of materials, soluble halide salts are used at many different points in the process of producing a photographic element.

Water soluble or aqueous soluble salts are used during the actual precipitation of the silver halide grains (e.g., EPO 174018), during growth and ripening steps in the preparation of the emulsion (e.g., U.S. Pat. No. 4,496,652), or are added to the emulsion immediately prior to coating (e.g., U.S. Pat. Nos. 4,332,888 and 4,536,473). Water soluble halide salts, particularly potassium bromide, are added as anti-fogging agents to photographic developer solutions. Most of these water soluble halide salts react to form insoluble salts or are washed out of the emulsion prior to being coated onto a substrate to form a photographic element. U.S. Pat. Nos. 4,332,888 and 4,536,473 do show the addition of water soluble halide (including bromide) salts into photographic emulsions before coating of the emulsions onto a carrier substrate. The concentration of these salts are much less than 0.1 g/m$^2$.

SUMMARY OF THE INVENTION

The addition of water soluble or aqueous alkaline soluble bromide salts into a non-silver halide layer on a photographic emulsion has been found to stabilize developer chemistry fluctuations in automatic processors. It is preferred that the layer(s) containing the water soluble halide salt be present on the side of the base away from the silver halide emulsions, as for example in an antihalation layer or backside topcoat layer.

DETAILED DESCRIPTION OF THE DRAWINGS

Figure 1:
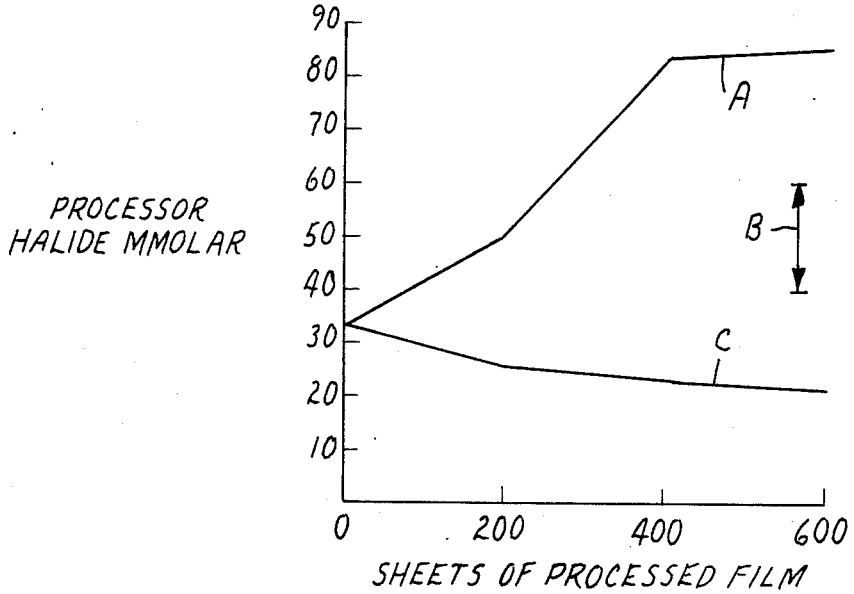
FIG. 1 shows a graph of the Concentration of Halide Ions versus the Number of Sheets of Processed Film for Examples 1 and 2 and conventional x-ray film.

FIG. 1 shows the effect of the addition of aqueous soluble bromide salts to an antihalation layer as shown in Example 2 (shown as line A) versus no salt addition (shown as line C) and conventional x-ray film (the range of which is labeled B). As can be seen, the addition of the salt raises the level of bromide in the developer solution (line A), while the film without bromide salt, line C (Example 1) causes the bromide concentration to drop below conventional levels.

Figure 2:
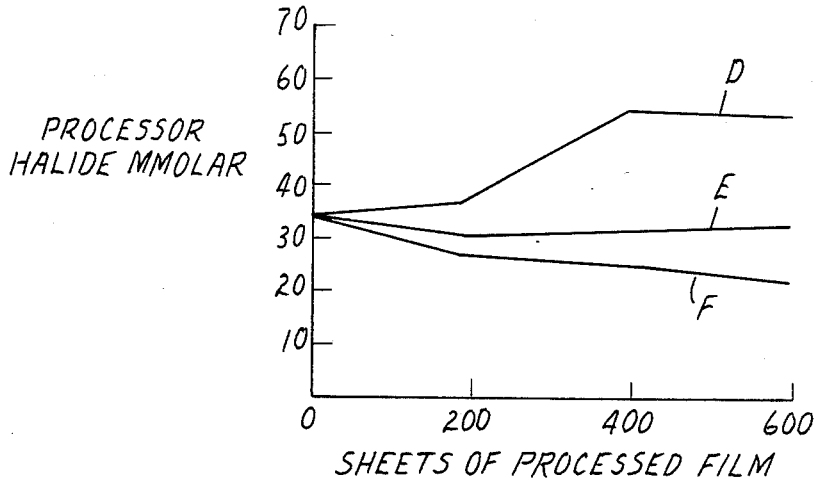
FIG. 2 shows a graph of Processor Solution Halide Concentration versus the Number of Sheets of Processed Film for Examples 16 and 17 and conventional x-ray film.

FIG. 2 shows similar results. A steady state concentration of bromide in the processor solution is reached (as shown in line E which represents the product of Example 17) when aqueous soluble halide salts are used in the photographic film antihalation layer. The film without soluble halide salt additives steadily decreased the concentration of bromide in the developer solution as shown by line F. Line D shows conventional coarse grain x-ray film with a very high (97%) bromide content (Example 18).

DETAILED DESCRIPTION OF THE INVENTION

Developer chemistry solutions used in automatic processors were noted by patentees as displaying higher levels of fluctuation as newer photographic elements are added to the processing line. These high levels of fluctuation resulted in poorer images being formed and with wide variations in image quality. These fluctuations were particularly unexpected since most newer photographic elements contained lower amounts of silver halide and were therefore expected to put lower stress on the developer chemistry by using lesser amounts of the active chemistry to produce a given area of developed image.

It was found by patentees that the high fluctuations in the developer chemistry were in part caused by a reduced amount of bromide ion being reintroduced into the developer chemistry upon development of the silver halide image. Ordinarily, silver halide emulsions release halide ion into the developer solution upon reduction of the silver halide grain. As conventional silver halide film, and particularly radiographic film, contains a significant if not major proportion of its silver halide as bromide, bromide ions were released into developer solutions.

Newer, higher speed photographic and especially radiographic black-and-white emulsions commonly contain lower coating weights of silver halide. In addition, they may have lower concentrations of bromide ions in the salts, including less than 50% of the total halide in the emulsion as bromide. This combination of lower bromide concentration and lower silver coating weights caused less bromide to be released into the developer solutions in automatic processors.

It has been found according to the practice of the present invention that the presence of an aqueous soluble (preferably water soluble) bromide salt in a non-silver halide containing layer of a photographic element reduces the levels of fluctuation in developer chemistry solutions in automatic processors.

Typical bromide salts which can be effectively used in photographic elements with little or no sensitometric interference are KBr, $CaBr_2$, NaBr, $NH_4Br$, $MgBr_2$, LiBr and the like. Organic halide salts may also be used to provide the available halide ions to practice the present invention. Other halide ions such as $I^-$ and $Cl^-$ may also be present as part of the salt. In some cases the presence of these other ions may be especially beneficial, but the bromide ion must still be present in the salt. To insure that there is the least likelihood of any adverse effects from the cation, it is desirable to have all of the silver halide emulsion layers on one side of the base and the aqueous alkaline soluble bromide salt on the other side of the base. It is required in the practice of the present invention to have at least 0.1 g/m$^2$ of bromide in the photographic element as water soluble bromide outside of silver halide containing layers. It is preferred that at least 0.2 g/m$^2$ of bromide, more preferred that at least 0.3 g/m$^2$ of bromide, and most preferred that at least 0.4 g/m$^2$ of bromide is present in the photographic element as water soluble bromide outside of silver halide containing layers. There generally should be less than 3.0 g/m$^2$ of said bromide, usually less than 1.0 g/m$^2$.

It is important that the high levels of water soluble bromide salt be present outside of the silver halide containing layers. It has been found that the addition of soluble halide salts to the emulsion layers, as suggested in U.S. Pat. No. 4,536,473, does not provide stable properties to the photographic elements. That patent teaches the use of water soluble bromide salts in infrared sensitized silver halide emulsions as a supersensitizer. However, the claims cover 0.0003 mole to 0.01 mole of water soluble bromide per mole of silver. Based on a silver coverage rate of 5 g Ag/m$^2$, this would correspond to roughly 0.0015 to 0.05 g of soluble bromide per square meter and would be insufficient to markedly alter the bromide level in the processor developer tank. It is therefore preferred that the required higher levels of soluble bromide salt be present in a layer free of silver halide and preferably in a layer on the opposite side of the base from silver halide emulsion such as antihalation layers or backside coatings.

The benefits of the present invention are particularly useful in black-and-white photographic film such a radiographic film, infrared sensitive film, graphic arts film, laser scanner film, and the like.

Any of the various types of photographic silver halide emulsions may be used in the practice of the present invention. Silver chloride, silver bromide, silver iodobromide, silver chlorobromide, silver chlorobromoiodide and mixtures thereof may be used for example. Any configuration of grains, cubic orthorhombic, hexagonal, epitaxial, lamellar, tabular or mixtures thereof may be used. These emulsions are prepared by any of the well-known procedures, e.g., single or double jet emulsions as described by Nietz et al., U.S. Pat. No. 2,222,264, Illingsworth, U.S. Pat. No. 3,320,069, McBride, U.S. Pat. No. 3,271,157 and U.S. Pat. Nos. 4,425,425 and 4,425,426.

The silver halide emulsions of this invention can be unwashed or washed to remove soluble salts. In the latter case the soluble salts can be removed by chill-setting and leaching or the emulsion can be coagulation washed e.g., by the procedures described in Hewitson et al., U.S. Pat. No. 2,618,556; Yutzy et al., U.S. Pat. No. 2,614,928; Yackel, U.S. Pat. No. 2,565,418; Hart et al., U.S. Pat, No. 3,241,969; and Waller et al., U.S. Pat. No. 2,489,341.

Photographic emulsions in accordance with this invention can be sensitized with chemical sensitizers, such as with reducing agents; sulfur, selenium or tellurium compounds; gold, platinum or palladium compounds; or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The silver halide emulsions of this invention can contain speed increasing compounds such as polyalkylene glycols, cationic surface active agents and thioethers or combinations of these as described in Piper, U.S. Pat. No. 2,886,437; Chechak, U.S. Pat. No. 3,046,134; Carroll et al., U.S. Patent 2,944,900; and Goffe, U.S. Pat. No. 3,294,540.

Silver halide emulsions of this invention can be protected against the production of fog and can be stabilized against loss of sensitivity during keeping. Suitable antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Pat. No. 623,448; nitron; nitroindazoles; the polyvalent metal salts described in Jones, U.S. Pat. No. 2,839,405; the thiuronium salts described in Herz, U.S. Pat. No. 3,220,839; and the palladium, platinum and gold salts described in Trivelli, U.S. Pat. No. 2,566,263 and Damschroder, U.S. Pat. No. 2,597,915.

Silver halide grains in accordance with the invention can be dispersed in colloids that can be hardened by various organic or inorganic hardeners, alone or in combination, such as the aldehydes, and blocked aldehydes, ketones, carboxylic and carbonic acid derivatives, sulfonate esters, sulfonyl halides and vinyl sulfones, active halogen compounds, epoxy compounds, aziridines, active olefins, isocyanates, carbodiimides, mixed function hardeners and polymeric hardeners such as oxidized polysaccharides, e.g., dialdehyde starch, oxyguargum, etc.

Photographic emulsions according to the present invention can contain various colloids alone or in combination as vehicles or binding agents. Suitable hydrophilic materials include both naturally-occurring substances such as proteins, for example, gelatin, gelatin derivatives (e.g., phthalated gelatin), cellulose derivatives, polysaccharides such as dextran, gum arabic and the like; and synthetic polymeric substances such as water soluble polyvinyl compounds, e.g., poly(vinylpyrrolidone) acrylamide polymers or other synthetic polymeric compounds such as dispersed vinyl compounds in latex form, and particularly those which increase the dimensional stability of the photographic materials. Suitable synthetic polymers include those described, for example, in U.S. Pat. Nos. 3,142,568 of Nottorf; 3,193,386 of White; 3,062,674 of Houck, Smith and Yudelson; 3,220,844 of Houck, Smith and Yudelson; Ream and Fowler, 3,287,289; and Dykstra, U.S. Pat. No. 3,411,911; particularly effective are those water-insoluble polymers of alkyl acrylates and methacrylates, acrylic acid, sulfoalkyl acrylates or methacrylates, those which have cross linking sites which facilitate hardening or curing and those having recurring sulfobetaine units as described in Canadian Pat. No. 774,054.

Emulsions in accordance with this invention can be used in photographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056 and 3,206,312 or insoluble inorganic salts such as those described in Trevoy, U.S. Pat. No. 3,428,451.

Photographic emulsions of the invention can be coated on a wide variety of supports. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

Emulsions of the invention can contain plasticizers and lubricants such as polyalcohols, e.g., glycerin and diols of the type described in Milton, U.S. Pat. No. 2,960,404; fatty acids or esters such as those described in Robijns, U.S. Pat. No. 2,588,765 and Duane, U.S. Pat. No. 3,121,060; and silicone resins such as those described in DuPont British Pat. No. 955,061.

The photographic emulsions as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers as described herein can contain matting agents such as starch, titanium dioxide, zinc oxide, silica, polymeric beads including beads of the type described in Jelley et al., U.S. Pat. No. 2992,101 and Lynn, U.S. Pat. No. 2,701,245.

Emulsions of the invention can be utilized in photographic elements which contain brightening agents including stilbene, triazine, oxazole and coumarin brightening agents. Water soluble brightening agents can be used such as those described in Albers et al., German Pat. No. 972,067 and McFall et al., U.S. Pat. No. 2,933,390 or dispersions of brighteners can be used such as those described in Jansen, German Pat. No. 1,150,274 and Oetiker et al., U.S. Pat. No. 3,406,070.

Photographic elements containing emulsion layers according to the present invention can be used in photographic elements which contain light absorbing materials and filter dyes such as those described in Sawdey, U.S. Pat. No. 3,253,921; Gaspar, U.S. Pat. No. 2,274,782; Carroll et al., U.S. Pat. No. 2,527,583 and Van Campen, U.S. Pat. No. 2,956,879. If desired, the dyes can be mordanted, fo example, as described in Milton and Jones, U.S. Pat. No. 3,282,699.

Contrast enhancing additives such as hydrazines, rhodium, iridium and combinations thereof are also useful.

Photographic emulsions of this invention can be coated by various coating procedures including dip coating, air knife coating, curtain coating, or extrusion coating using hoppers of the type described in Beguin, U.S. Pat. No. 2,681,294. If desired, two or more layers may be coated simultaneously by the procedures described in Russell, U.S. Pat. No. 2,761,791 and Wynn, British Pat. No. 837,095.

The couplers may be present either directly bound by a hydrophilic colloid or carried in a high temperature boiling organic solvent which is then dispersed within a hydrophilic colloid. The colloid may be partially hardened or fully hardened by any of the variously known photographic hardeners. Such hardeners are free aldehydes (U.S. Pat. No. 3,232,764), aldehyde releasing compounds (U.S. Pat. Nos.2,870,013 and 3,819,608), s-triazines and diazines (U.S. Pat. Nos. 3,325,287 and 3,992,366), aziridines (U.S. Pat. No. 3,271,175), vinylsulfones (U.S. Pat. No. 3,490,911), carbodiimides, and the like may be used.

The silver halide photographic elements can be used to form dye images therein through the selective formation of dyes. The photographic elements described above for forming silver images can be used to form dye images by employing developers containing dye image formers, such as color couplers, as illustrated by U.K. Pat. No. 478,984; Yager et al., U.S. Pat. No. 3,113,864; Vittum et al., U.S. Pat. Nos. 3,002,836, 2,271,238 and 2,362,598. Schwan et al. U.S. Pat. No. 2,950,970; Carroll et al., U.S. Pat. No. 2,592,243; Porter et al., U.S. Pat. Nos. 2,343,703, 2,376,380 and 2,369,489; Spath U.K. Pat. No. 886,723 and U.S. Pat. No. 2,899,306; Tuite U.S. Pat. No. 3,152,896 and Mannes et al., U.S. Pat. Nos. 2,115,394, 2,252,718 and 2,108,602, and Pilato U.S. Pat. No. 3,547,650. In this form the developer contains a color-developing agent (e.g., a prmmary aromatic amine which in its oxidized form is capable of reacting with the coupler (coupling) to form the image dye. Also, instant self-developing diffusion transfer film can be used as well as photothermographic color film or paper using silver halide in catalytic proximity to reducable silver sources and leuco dyes.

The dye-forming couplers can be incorporated in the photographic elements, as illustrated by Schneider et al. Die Chemie, Vol. 57, 1944, p. 113, Mannes et al. U.S. Pat. No. 2,304,940, Martinez U.S. Pat. No. 2,269,158, Jelley et al. U.S. Pat. No. 2,322,027, Frolich et al. U.S. Pat. No. 2,376,679, Fierke et al. U.S. Pat. No. 2,801,171, Smith U.S. Pat. No. 3,748,141, Tong U.S. Pat. No. 2,772,163, Thirtle et al. U.S. Pat. No. 2,835,579, Sawdey et al. U.S. Pat. No. 2,533,514, Peterson U.S. Pat. No. 2,353,754, Seidel U.S Pat. No. 3,409,435 and Chen Research Disclosure, Vol. 159, July 1977, Item 15930. The dye-forming couplers can be incorporated in different amounts to achieve differing photographic effects. For example, U.K. Pat. No. 923,045 and Kumai et al. U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are non-diffusible, colorless couplers, such as two and four equivalent couplers of the open chain ketomethylene, pyrazolone, pyrazolone, pyrazolotriazole, pyrazolobenzimidazole, phenol and naphthol type hydrophobically ballasted for incorporation in high-boiling organic (coupler) solvents.

Other conventional photographic addenda such as coating aids, antistatic agents, acutance dyes, antihalation dyes and layers, antifoggants, latent image stabilizers, antikinking agents, and the like may also be present.

Although not essential in the practice of the present invention, one particularly important class of additives which finds particular advantage in the practice of the present invention is high intensity reciprocity failure (HIRF) reducers. Amongst the many types of stabilizers for this purpose are chloropalladites and chloroplatinates (U.S. Pat. No. 2,566,263), iridium and/or rhodium salts (U.S. Pat. Nos. 2,566,263; 3,901,713), cyanorhodates (Beck et al., J. Signalaufzeichnungsmaterialen, 1976, 4, 131), and cyanoiridates

EXAMPLE 1-2

The invention is described in detail by the following examples. A fine grain emulsion was prepared by a double jet precipitation to provide a 64% chloride and 36% bromide emulsion with an average size of 0.24 micrometers. It was chemically digested with p-toluenesulfinic acid, sodium thiosulfate and sodium gold tetrachloride ($NaAuCl_4$). Final preparation of the emulsion comprised the addition of water and gelatin to a level of 5.0% gelatin and 2500g of emulsion per mole of silver. The pH was adjusted to 7.0, and the pAg was adjusted to 7.2.

The emulsion was sensitized to the infrared by the addition of 30 mg/mole Ag of dye 1 as a 0.04% methanol solution. Two supersensitizers were also added. Poly(ethylacrylate) was added at 30g of solid/mole Ag as a 20% aqueous solution followed by 115 mg/mole Ag of phenylmercaptotetrazole (PMT) as a 1.0% methanol solution.

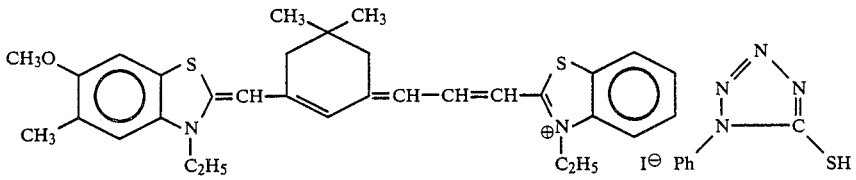

Dye 1

PMT

A surfactant and formaldehyde were added, and the emulsion was coated at a silver weight of 2.5g/$m^2$ on 7 mil blue polyester. A protective gelatin topcoat was coated over the emulsion.

The infrared sensitized, chlorobromide emulsion described previously was coated on two 7 mil polyester bases differing only in the antihalation backside coating. The antihalation (AH) underlayer formulas are given in Table I. Both antihalation backing layers were coated at a wet load of 64 ml of AH/$m^2$. Both AH coatings were overcoated with an aqueous gelatin topcoat at 21 ml/$m^2$.

TABLE I

| Additives | AH Formulas EXAMPLE 1 Control | EXAMPLE 2 Bromide AH Formula |
|---|---|---|
| Gelatin | 48 g | 48 g |
| DI Water | 842 g | 774 g |
| Wetting Agent | 29 g | 29 g |
| 20% KBr | — | 67.5 g |
| IR AH Dye | 77 g | 77 g |
| 3.7% Formaldehyde | 4.4 g | 4.4 g |
| | 1000 g | 1000 g |

Approximate calculations can be performed to determine the quantity of halides which would leach out of the photographic films during the development stage. These are shown in Table II for Examples 1 and 2 and also for a typical conventional X-Ray film with 4.5 g Ag/$m^2$ and a composition of 98% bromide and 2% iodide. The small iodide percentage has been omitted from the calculations. The first 14 lines in Table II refer to the silver halide emulsion layer. Lines 10–14 are basically a third of lines 6–9. The reason for this calculation is that roughly a third of the cationic silver is converted to metallic silver in a typical X-Ray film. This would allow the release of only a third of the halide present into the developer bath. Line 17 shows a full release of bromide from the antihalation layer in Example 2. The bromide in the AH layer is free bromide and is not complexed with silver. The numbers in lines 18 and 19 show that Example 2, where bromide was added to the AH layer, would release bromide and total helide similar to a conventional X-Ray film coated at a much grater silver coating weight.

TABLE II

Halide Release From Films During Development

| Line | Halide | Layer | Ex. 1 Control | Ex. 2 AB + Br | Conventional X-Ray |
|---|---|---|---|---|---|
| 1 | Silver per square meter | Emul | 2.5 | 2.5 | 4.5 |
| 2 | Moles of Ag/$m^2$ | Emul | 0.0231 | 0.0231 | 0.0417 |
| 3 | % Bromide | Emul | 36 | 36 | 98 |
| 4 | % Iodide | Emul | — | — | 2 |
| 5 | % Chloride | Emul | 64 | 64 | — |
| 6 | Moles of Bromide/$m^2$ | Emul | 0.0083 | 0.0083 | 0.0409 |
| 7 | Moles of Chloride/$m^2$ | Emul | 0.0148 | 0.0148 | — |
| 8 | Grams of Bromide/$m^2$ | Emul | 0.66 | 0.66 | 3.27 |
| 9 | Grams of Chloride/$m^2$ | Emul | 0.52 | 0.52 | — |
| 10 | Moles Br Released/$m^2$ | Emul | 0.0028 | 0.0028 | 0.0136 |
| 11 | Moles Cl Released/$m^2$ | Emul | 0.0049 | 0.0049 | — |
| 12 | Grams Br Released/$m^2$ | Emul | 0.22 | 0.22 | 1.09 |
| 13 | Grams Cl Released/$m^2$ | Emul | 0.18 | 0.18 | — |
| 14 | Total Moles of Halide released/$m^2$ | Emul | 0.0077 | 0.0077 | 0.0136 |
| 15 | Moles of Bromide/$m^2$ | AH | — | 0.0076 | — |
| 16 | Grams of Bromide/$m^2$ | AH | — | 0.61 | — |
| 17 | Moles Br Released/$m^2$ | AH | — | 0.0076 | — |
| 18 | Total Moles Br Released/$m^2$ | Emul/AH | 0.0028 | 0.0104 | 0.0136 |
| 19 | Total Moles Halide Released/$m^2$ | Emul/AH | 0.0077 | 0.0153 | 0.0136 |

The calculations were tested with a processor study to verify the halide release during extended prcessing of Examples 1 and 2. The experiment was performed with a 3M XP-515, 90 second, automatic processor with Kodak RP X-Omat developer and fix replenishers. The 2.5 gallon developer tank in the processor was drained and filled with development replenisher. The XP-515 processor was set at 95° F. developer temperature with replenisher rates of 40 ml and 100 ml for the developer and fix replenisher solutions respectively. In addition, 220 ml of Kodak starter solution was added to the developer tank. The development replenisher does not contain bromide, but the starter does have bromide present. After addition of the starter solution, the bromide level of the developer tank was measured as 34 mmolar by titrating to a visual endpoint.

The titration procedure does not differentiate between bromide and chloride. This was verified by correctly measuring a 70 mmolar chloride solution. Therefore, in a mixed system containing chloride and bromide, the visual endpoint titration value will give the total molar concentration of bromide and chloride.

FIG. 1 shows the titrated concentration of halides (bromide and chloride) in the developer tank initially and after processing 200 sheet increments of low silver film without bromide in the AH (Example 1). The same procedure was repeated with the low silver film containing bromide (Example 2). This included first draining the developer tank, filling with replenisher and adding starter solution.

The effect of adding bromide to the AH is apparent from FIG. 1. The halide level in the developer dropped below the standard levels expected for conventional X-Ray films as low silver film (Example 1) was processed. Developer chemistries measured from hospital processors range from 40 to 60 mmolar in bromide. The addition of bromide to the AH layer (Example 2) of the lower silver film generated a high halide concentration in the developer. The ideal level of bromide addition to the AH layer for this experiment would be 30 to 40g of 20% KBr/Kg AH versus the 67.5 g of 20% KBr/Kg AH used in Example 2. The addition of 30 to 40 g of 20% KBr/Kg AH corresponds to the coating of 0.27 to 0.36 g/m$^2$ of bromide anion in the described AH formulas coated at 64 ml/m$^2$. However, the ideal level of bromide addition to the AH also depends on the developer replenisher rate. The rate in this experiment was 40 ml but more often is 55 ml in hospitals. The higher developer replenish flow will lower the bromide steady state level in the developer tank of the processor.

EXAMPLES 3–15

Other bromide counterions were examined besides potassium. These included sodium, calcium and ammonium. The hardness level of the film and different levels of KBr were also evaluated. The general formula for the AH layers was the same as given in Table I changing only bromide and formaldehyde as listed in Table III. Examples 3–15 were coated as antihalation underlayers at a wet load of 64ml of AH/m$^2$ and overcoated with an aqueous gelatin topcoat at 21 ml/m$^2$. The opposite side of each AH layer was then coated with emulsion as in Examples 1 and 2. The materials were evaluated for blocking after a three day incubation period at 50° C. The results of the blocking test are given in Table III and show little effect in changing the counterion from potassium to sodium, calcium or ammonium. The high level of KBr used in Example 5, 7 and 9 exhibits poor blocking characteristics although the higher formaldehyde level in Example 9 helps reduce the problem. Therefore, bromide can be introduced into the antihalation layer as the salt of many counterions.

TABLE III

| Example | Bromide Salt | Alternate Bromide Sources: 20% Salt Solution (g/Kg AH) | Bromide* Anion (g/m$^2$ AH) | 3.7% HCHO per Kg AH | Blocking Test** |
|---|---|---|---|---|---|
| 3 | none | — | — | 4.4 | 10.0 |
| 4 | KBr | 35 | 0.32 | 4.4 | 10.0 |
| 5 | KBr | 70 | 0.63 | 4.4 | 3.0 |
| 6 | KBr | 35 | 0.32 | 8.8 | 9.5 |
| 7 | KBr | 70 | 0.63 | 8.8 | 3.0 |
| 8 | KBr | 35 | 0.32 | 13.2 | 9.5 |
| 9 | KBr | 70 | 0.63 | 13.2 | 6.5 |
| 10 | NaBr | 30.3 | 0.32 | 4.4 | 8.5 |
| 11 | NaBr | 30.3 | 0.32 | 13.2 | 9.5 |
| 12 | $CaBr_2$ | 29.4 | 0.32 | 4.4 | 10 |
| 13 | $CaBr_2$ | 29.4 | 0.32 | 13.2 | 10 |
| 14 | $NH_4Br$ | 28.8 | 0.32 | 4.4 | 10 |
| 15 | $NH_4Br$ | 28.8 | 0.32 | 13.2 | 9.5 |

*Grams of bromide anion per square meter of AH.
**3 by 3" stacked films at 80° F. and 80% RH for 4.5 h under 4.6 Kg weight. Films conditioned first for 24 hours at 80° F. and 80% RH. The rating system is 10 for no blocking or sticking and a 1 for severely blocked.

EXAMPLES 16–18

The sensitometric effects of bromide in the processor developer are demonstrated by Examples 16–18. Example 16 was identical to Example 1 and was comprised of a 64/36 chlorobromide emulsion coated at 2.5 g Ag/m$^2$. The antihalation layer was the same as Example 1 in Table 1 and did not contain bromide. Example 17 was similar to Example 2 but with 35 g of 20% KBr/KgAH versus 67.5 g. Example 18 was a conventional green sensitive X-ray film coated with emulsion on both sides of the base at 4.5 g Ag/m$^2$ and described in Table II. Table IV gives a full description of the trial films.

TABLE IV

| Film | Layer | Example 16 | Example 17 | Example 18 |
|---|---|---|---|---|
| Silver/m$^2$ | Emul | 2.5 | 2.5 | 4.5 |
| % Chloride | Emul | 64 | 64 | — |
| % Bromide | Emul | 36 | 36 | 98 |
| % Iodide | Emul | — | — | 2 |
| Grain Size ($\mu$) | Emul | 0.24 | 0.24 | 0.90 |
| Sensitivity | Emul | IR | IR | Green |
| $Br^-$ (g/m$^2$) | AH | — | 0.32 | — |
| $Br^-$ (moles/m$^2$) | AH | — | 0.0040 | — |

The trial films, Example 16–18, were examined for halide release and sensitometric effects over extended processing in a Kodak M6, automatic processor. The remainder of the test procedure was identical to Examples 1 and 2 except for adjustment of the developer replenisher rate to 55 ml and the fix replenisher rate to 110 ml.

FIG. 2 shows the titrated concentration of halides (bromide and chloride) in the developer tank initially and after processing 200 sheet increments of low silver film without bromide in the AH (Example 16). The same procedure was repeated with the film feedstock changed to Example 17 (bromide in AH) and the conventional X-ray film (Example 18). The developer tank was drained, refilled with developer replenisher and starter solution added before switching to the next film feedstock.

Sensitometric effects were also examined by running exposed control strips of the IR (Example 16) and conventional film (Example 18) every 200 sheets of film feedstock. The IR film was exposed at $10^{-3}$ seconds through an 820 narrow band filter and a 0–3 continuous wedge. The conventional, green sensitive X-ray film was evaluated with a 1/10 second exposure from a tungsten light source with a color temperature of 2650° K. The light was filtered with a Corning 5461 green filter. The sensitometric results are listed in Table V and include $D_{min}$, $D_{max}$, Spd (speed at O.D. =1.0 above fog) and Cont (average contrast).

The sensitometric data show two major trends. First, the fog level for the conventional X-ray film was more stable when the halide concentration stayed at the initial 34 mmolar level (Example 17) or improved as the halide concentration rose (Example 18). The second effect was a slight rise in contrast as the bromide level remained constant or rose.

TABLE V

| | | Sensitometric Effects | | | | | | | | |
|---|---|---|---|---|---|---|---|---|---|---|
| | Sheets | IR Film, Example 16 | | | | X-Ray Film, Example 18 | | | | Halide |
| Feedstock | Processed | Dmin | Dmax | Spd | Cont | Dmin | Dmax | Spd | Cont | (mmolar) |
| Ex 16 | 0 | 0.17 | 3.31 | 2.19 | 2.40 | 0.19 | 3.31 | 1.71 | 2.56 | 36 |
| Ex 16 | 200 | 0.17 | 3.34 | 2.22 | 2.35 | 0.20 | 3.34 | 1.72 | 2.59 | 28 |
| Ex 16 | 400 | 0.17 | 3.30 | 2.23 | 2.31 | 0.21 | 3.34 | 1.74 | 2.52 | 25 |
| Ex 16 | 600 | 0.17 | 3.32 | 2.22 | 2.32 | 0.21 | 3.34 | 1.74 | 2.57 | 21 |
| Ex 17 | 0 | 0.18 | 3.38 | 2.20 | 2.34 | 0.19 | 3.32 | 1.75 | 2.53 | 34 |
| Ex 17 | 200 | 0.17 | 3.36 | 2.22 | 2.40 | 0.19 | 3.35 | 1.74 | 2.66 | 30 |
| Ex 17 | 400 | 0.17 | 3.37 | 2.23 | 2.35 | 0.20 | 3.34 | 1.74 | 2.71 | 32 |
| Ex 17 | 600 | 0.17 | 3.36 | 2.22 | 2.39 | 0.20 | 3.35 | 1.76 | 2.63 | 34 |
| Ex 18 | 0 | 0.17 | 3.33 | 2.21 | 2.43 | 0.19 | 3.32 | 1.73 | 2.58 | 34 |
| Ex 18 | 200 | 0.17 | 3.36 | 2.22 | 2.47 | 0.19 | 3.33 | 1.73 | 2.65 | 36 |
| Ex 18 | 400 | 0.17 | 3.34 | 2.22 | 2.56 | 0.19 | 3.39 | 1.76 | 2.68 | 55 |
| Ex 18 | 600 | 0.17 | 3.37 | 2.22 | 2.55 | 0.18 | 3.42 | 1.73 | 2.72 | 54 |

What is claimed is:

1. A photographic element comprising a base layer and at least one silver halide photographic emulsion on one side of said base, said element characterized by having at least one layer thereon which is free of silver halide and contains at least 0.1 g/m$^2$ of bromide ion as an aqueuus alkaline soluble bromide salt wherein said salt is selected from the group consisting of KBr, NaBr, MgBr2, $CaBr_2$, and $NH_4Br$.

2. A photographic element comprising a base layer and at least one silver halide photographic emulsion on one side of said base, said element characterized by having at least one layer thereon which is free of silver halide and contains at least 0.1 g/m$^2$ of bromide ion as an agueous alkaline soluble bromide salt wherein said at least one layer is on the side of the base opposite from said at least one emulsion.

3. The element of claim 2 wherein said bromide salt is present in a concentration of at least 0.3 g/m$^2$ up to 3.0 g/m$^2$.

4. A photographic element for use with liquid photographic developers in development tanks comprising a base layer and at least one silver halide photographic emulsion on one side of said base, said element characterized by having at least one layer thereon which is free of silver halide and contains at least 0.2 g/m$^2$ of bromide as an aqueous alkaline soluble bromide salt wherein said at least one layer is on the side of the base opposite from said at least one emulsion.

5. The element of claim 3 wherein said at least one layer is on the side of the base opposite from said at least one emulsion.

6. The element of claim 4 wherein said bromide salt is present in a concentration of at least 0.4 g/m$^2$ up to 1.0 g/m$^2$.

7. The elemnnt of claim 1 wherein said at least one layer is on the side of the base opposite from said at least one emulsion.

8. A photographic element for use with liquid photographic developers in development tanks comprising a base layer and at least one silver halide photographic emulsion on one side of said base, said element characterized by having at least one layer thereon which is free of silver halide and contains at least 0.2 g/m$^2$ of bromide as an aqueous alkaline soluble bromide salt wherein said silver halide emulsion layer is spectrally sensitized to the infrared.

9. The element of claim 8 wherein said bromide salt is present in a concentration of at least 0.4 g/m$^2$ up to 1.0 g/m$^2$.

10. The element of claim 1 wherein said silver halide emulsion layer is spectrally sensitized to the infrared.

11. The element of claim 4 wherein said silver halide emulsion layer is spectrally sensitized to the infrared.

12. The element of claim 6 wherein said silver halide emulsion layer is spectrally sensitized to the infrared.

13. The element of claim 2 wherein said salt is selected from the group consisting of KBr, NaBr, $MgBr_2$ LiBr, $CaBr_2$, and $NH_4Br$.

14. A photocraphic element for use with liquid photographic developers in development tanks comprising a base layer and at least one silver halide photographic emulsion on one side of said base, said element characterized by having at least one layer thereon which is free of silver halide and contains at least 0.2 g/m$^2$ of gromide as an aqueous alkaline soluble bromide salt wherein said salt is selected from the group consisting of KBr, NaBr, $MgBr_2$, LiBr, $CaBr_2$, and $NH_4Br$.

15. The element of claim 4 wherein said salt is selected from the group consisting of KBr, NaBr, $MgBr_2$, LiBr, $CaBr_2$, and $NH_4Br$.

16. The element of claim 5 wherein said salt is selected from the group consisting of KBr, NaBr, $MgBr_2$, LiBr, $CaBr_2$, and $NH_4Br$.

* * * * *

UNITED STATES PATENT AND TRADEMARK OFFICE

CERTIFICATE OF CORRECTION

PATENT NO. : 4,794,070

DATED : December 27, 1988

INVENTOR(S) : Philip, Sills and Lindquist

It is certified that error appears in the above-identified patent and that said Letters Patent is hereby corrected as shown below:

Column 6, line 20, "prmmary" should be --primary--.

Column 8, line 45, "grater" should be --greater--.

Column 8, Table II, Ex. 2, "AB+Br" should be --AH+Br--.

Column 8, line 41, "helide" should be --halide--.

Signed and Sealed this

Twenty-first Day of November, 1989

*Attest:*

JEFFREY M. SAMUELS

*Attesting Officer* *Acting Commissioner of Patents and Trademarks*